United States Patent [19]

Murray et al.

[11] Patent Number: 4,588,024

[45] Date of Patent: May 13, 1986

[54] INDIRECT HEAT EXCHANGER WITH BAFFLES

[75] Inventors: Norman R. Murray; Harold R. Hunt, both of Bartlesville, Okla.

[73] Assignee: Phillips Petroleum Company, Bartlesville, Okla.

[21] Appl. No.: 356,593

[22] Filed: Mar. 9, 1982

[51] Int. Cl.[4] ..... F28F 13/12; F28F 9/22; F28D 7/02

[52] U.S. Cl. ..... 165/109.1; 165/160; 165/162

[58] Field of Search ..... 165/109, 162, 160, 159, 165/74, 163

[56] References Cited

U.S. PATENT DOCUMENTS

| | | | |
|---|---|---|---|
| 13,721 | 10/1955 | Hogg | 165/109 R |
| 908,465 | 1/1909 | Jett | 165/163 |
| 1,874,679 | 8/1932 | Willoughby | 165/74 |
| 2,146,245 | 2/1939 | Barnes | 165/109 |
| 2,875,027 | 2/1959 | Dye | 165/162 X |
| 3,496,997 | 2/1970 | Weber | 165/163 |
| 3,595,309 | 7/1971 | Hawkins | 165/163 |
| 3,978,918 | 9/1976 | Nagatomo et al. | 165/163 |
| 4,203,906 | 5/1980 | Takada et al. | 165/159 |

FOREIGN PATENT DOCUMENTS

| | | | |
|---|---|---|---|
| 2734060 | 2/1979 | Fed. Rep. of Germany | 165/163 |
| 1182978 | 7/1959 | France | 165/163 |
| 0623100 | 7/1978 | U.S.S.R. | 165/163 |

*Primary Examiner*—Albert W. Davis, Jr.
*Assistant Examiner*—John K. Ford
*Attorney, Agent, or Firm*—C. F. Steininger

[57] ABSTRACT

An indirect heat exchanger having interconnected tubes arranged to form a plurality of generally-parallel, elongated tube sections spaced from one another in a predetermined pitch pattern to form geometric void spaces between adjacent combinations of the tube sections in planes generally-perpendicular to the tube sections and separate baffle plates arranged in each of a plurality of spaced planes generally-perpendicular to the tube sections so that there is a void space on all sides of the baffle plates in each plane and arranged in different planes so that there is a void space in the planes in front of and behind each baffle. In a preferred configuration the tubes are arranged in concentric circles and the planes are spaced at a plurality of angular positions.

6 Claims, 6 Drawing Figures

INDIRECT HEAT EXCHANGER WITH BAFFLES

The present invention relates to indirect heat exchangers. More specifically, the present invention relates to indirect heat exchangers with a novel baffling arrangement.

BACKGROUND OF THE INVENTION

Numerous indirect heat exchanger designs have heretofore been proposed. One of the most effective and widely used indirect heat exchangers is a tube and shell type exchanger wherein one fluid is disposed in interconnected tubing, while the second fluid is disposed in contact with the outside of the tubing in a shell or other enclosure. Usually, at least one of the fluids is in continuous flow and, in some cases, both fluids are flowing in a concurrent or countercurrent direction and in yet other cases, one of the fluids is caused to flow noncontinuously, as by a stirrer or pump which simply recirculates or moves a single body of fluid, usually the fluid in the container or shell outside the tubing. Most such tube and shell type heat exchangers also include baffles which serve the dual purpose of supporting the tubes within the shell and to deflect, check or regulate the flow of fluid through the shell.

An important objective in the design of all heat exchangers is to attain the most effective heat exchange possible. In this way, improved heat exchange can be attained with a given size heat exchanger or equivalent heat exchange may be obtained with a smaller heat exchanger. In most cases, the radical difference between the temperature of the fluid within the coils and the fluid outside the coils creates problems, due to the fact that the tubes must be permitted to move relative to one another because of expansion and contraction. Many baffle designs hold the tubes rigidly, thus preventing relative movement and ultimately causing damage to the exchanger if relative movement does occur. In some cases the differences in temperature between the two fluids are so great as to limit the capacity of the exchanger. For example, in reactors for chemical reactions, such as those for the dimerization of olefins, polymerizations and other reactions which are highly exothermic or endothermic, heat transfer is a limitation on the reactor capacity.

It is, therefore, an object of the present invention to provide an improved heat exchanger which overcomes the above-mentioned and other deficiencies of the prior art. Another object of the present invention is to provide an improved heat exchanger having a novel baffle arrangement. A further object of the present invention is to provide an improved heat exchanger with a novel baffle arrangement which improves the heat exchange capacity of the exchanger. Another and further object of the present invention is to provide an improved tube and shell type heat exchanger with a novel baffle design which improves the circulation of fluid in the shell. Yet another object on the present invention is to provide an improved heat exchanger with a novel baffle arrangement which permits the tubes to expand or contract without difficulty. A still further object of the present invention is to provide an improved heat exchanger with a novel baffle arrangement which permits the conduct of highly exothermic or endothermic heat exchange. Another and further object of the present invention is to provide an improved reactor for the conduct of chemical reactions in which heat exchange coils are disposed within the vessel and a novel baffle arrangement is provided. Another object of the present invention is to provide a reactor having heat exchange tubes disposed in the vessel, a stirring means for circulating fluid in the vessel and a novel baffle arrangement. These and other objects of the present invention will be apparent from the following description.

SUMMARY OF THE INVENTION

The present invention relates to an indirect heat exchanger having interconnected tube means forming a plurality of generally parallel, elongated tube sections spaced from one another in a predetermined pitch pattern to form geometric void spaces between adjacent combinations of said tube sections in planes generally-perpendicular to said tube sections; and a plurality of baffle plates coincident with each of a plurality of planes generally-perpendicular to said tube sections and spaced along the length of said tube sections;

each of said baffle plates spanning at least on of said void spaces;

said baffle plates in each of said plurality of planes generally-perpendicular to said tube sections being spaced in said each of said plurality of planes generally perpendicular to said tube sections to leave a void space equal in length to each side dimension of each said baffle plate adjacent each side of each baffle plate; and said baffle plates being spaced along the length of said tube sections to leave at least one void space equal in transverse dimensions to a given baffle plate in each of said plurality of planes generally-perpendicular to said tube sections at both the front and rear of said given baffle plate. In the preferred embodiment, the tubes are formed in concentric circles and the planes generally-perpendicular to the tubes are at spaced angles with respect to each other.

DESCRIPTION OF THE PREFERRED EMBODIMENTS

The nature and advantage of the present invention will be apparent from the following description when read in conjunction with the drawings.

Figure 1:
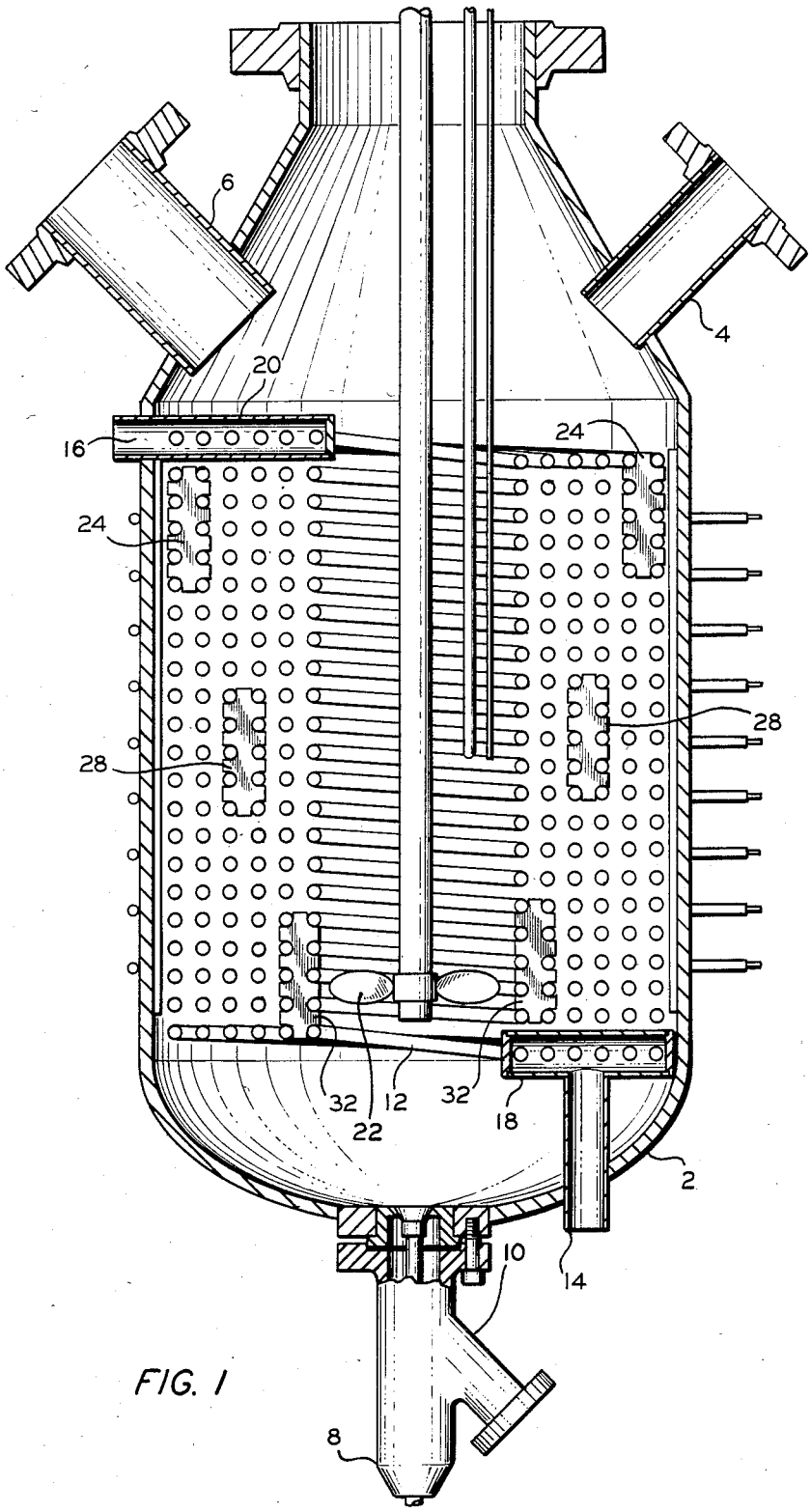
FIG. 1 of the drawings is a cross sectional view of a reactor having one embodiment of the heat exchanger of the present invention.

FIG. 1 of the drawings illustrates a preferred embodiment of the present invention comprising a reactor for carrying out highly exothermic or endothermic reactions in which heat exchange is necessary in order to control the reaction. In accordance with FIG. 1, the reactor comprises an outer shell or vessel 2 provided at the upper end with one or more inlets, in the present case two inlets, 4 and 6, respectively. Communicating with the bottom of the vessel is an outlet valve 8 coupled to outlet 10. Disposed within vessel 2 are interconnected tubes 12 arranged in concentric circles. Cooling or heating fluid is introduced into the tubes either through inlets 14 or 16, depending upon the nature of the heat exchange fluid and the nature of the reaction to be conducted, while the other of 14 and 16 serves as a discharge for the heat exchange fluid. The tubes 12 are operably connected to inlet and/or outlet 14 and 16 through appropriate headers 18 and 20, respectively. The tubes 12 are also arranged concentrically about a hollow core within which is disposed an appropriate stirring means, such as, stirrer 22. Disposed in a plurality of planes generally-perpendicular to the tubes are a plurality of baffle plates 24, 28 and 32, respectively.

Figure 2:
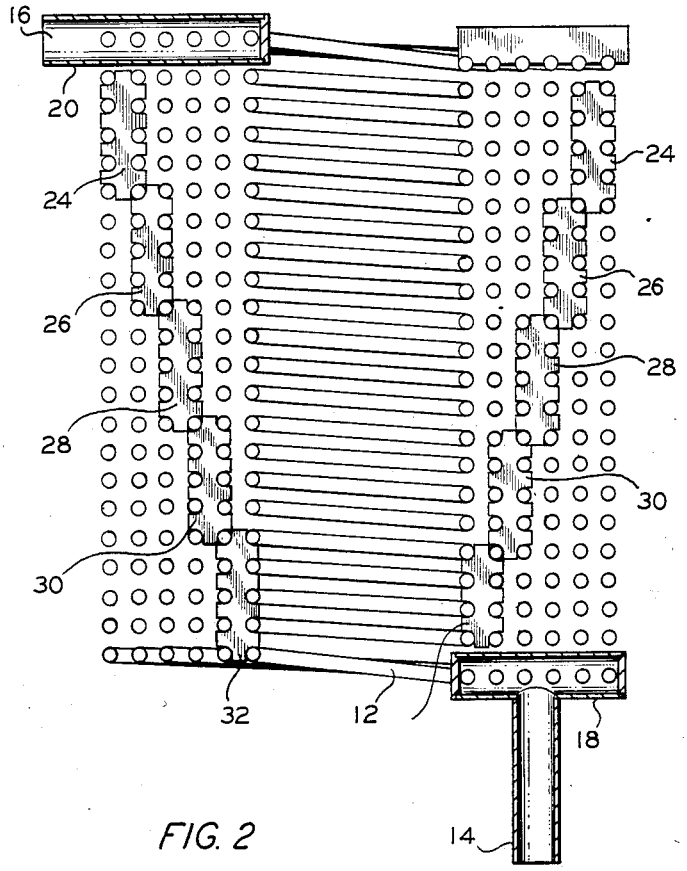
FIG. 2 is a cross sectional view of the tube and baffle arrangement of the reactor of FIG. 1.
Figure 3:
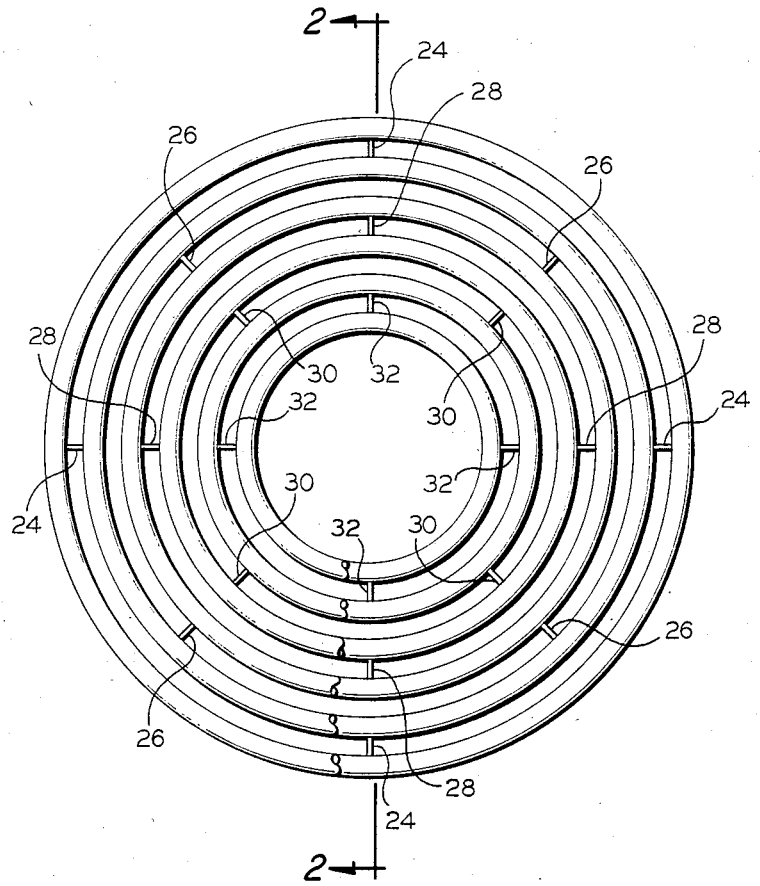
FIG. 3 is a view of the top of the arrangement of FIG. 2 showing the orientation of the baffles.

The arrangement of the baffles is better illustrated in FIGS. 2 and 3 of the drawings. In accordance with FIGS. 2 and 3, it is to be noted that baffles 24, 28 and 32 are all located in a single plane generally-perpendicular to the coils and that there are a plurality of such planes angularly spaced from one another about the coils, specifically at 90° angles from one another. Likewise, baffles 26 and 30 are located in a different single plane generally perpendicular to the tubes and a pluraltiy of such planes having baffles 26 and 30 coincident therewith are angularly spaced from one another about the coils specifically 90° from one another. Consequently, the planes with which the baffle plates 24, 26, 28 and 32 are coincident are arranged at regularly spaced angular positions about the coils and specifically baffles 24, 28 and 32 are coincident with a plane which is 45° removed from the plane with which baffles 26 and 30 are coincident. It should also be observed by viewing FIGS. 2 and 3 and particularly FIG. 2 that baffles 24, 26, 28, 30 and 32 are disposed at different levels with respect to one another. By way of example, starting at the top of the device, baffles 24 are located on level 1, 26 on level 2, 28 on level 3, 30 on level 4 and 32 on level 5. It is also to be observed that each of the baffles span at least one of the void spaces formed between adjacent combinations of tube sections in the planes perpendicular to the tube sections and specifically in the embodiment shown, each baffle spans 4 such void spaces. In addition, each baffle plate in each of the vertical planes has at least one void space equal in length to each side dimension of the baffle plate adjacent each side of the baffle plate. Specifically, 1 void space equal in width to the one void space of baffle plate 32 is adjacent the top of baffle 32 and 4 void spaces exist adjacent the side of baffle plate 32. By the same token, 1 void space are adjacent the bottom of baffle plate 28, 1 void space adjacent the top of baffle plate 28, 4 void spaces to the right of baffle 28 and 4 void spaces to the left of baffle plate 28. Finally, at least one void space, equal in transverse dimensions to a given baffle plate coincident with a given plane perpendicular to the tube sections, exists between the baffle plates in each level of baffle plates. Specifically, between the baffle plates 24, 28 and 32 and 2 of the planes perpendicular to the tubes there is a void space in the plane with which baffle plates 26 and 30 are coincident and between the baffle plates 26 and 30, respectively, there is a void space in the plane with which baffle plates 24, 28 and 32 are coincident.

As a result of the arrangement of baffles and the reactor illustrated in FIGS. 1–3, a baffling effect nearly as effective as conventional baffles is provided, while at the same time permitting the coils to expand or contract without difficulty. The baffle design also allows the use of a smaller diameter vessel than one having conventional baffles and the cooling coils are more economical to manufacture than vertical tubes or "harp" coils. Finally, the baffle design makes it possible to carry out highly exothermic or endothermic reactions where heat transfer is the limitation on reactor capacity. The baffle arrangement also greatly aids the mixing device in the mixing or agitation of the reactants in the vessel.

While the preferred embodiment of the present invention is illustrated in FIGS. 1–3, it is to be noted that various other arrangement of indirect, tube and shell type heat exchangers will be apparent to one skilled in the art and many modifications are possible without departing from the basic concepts of the present invention.

Figure 5:
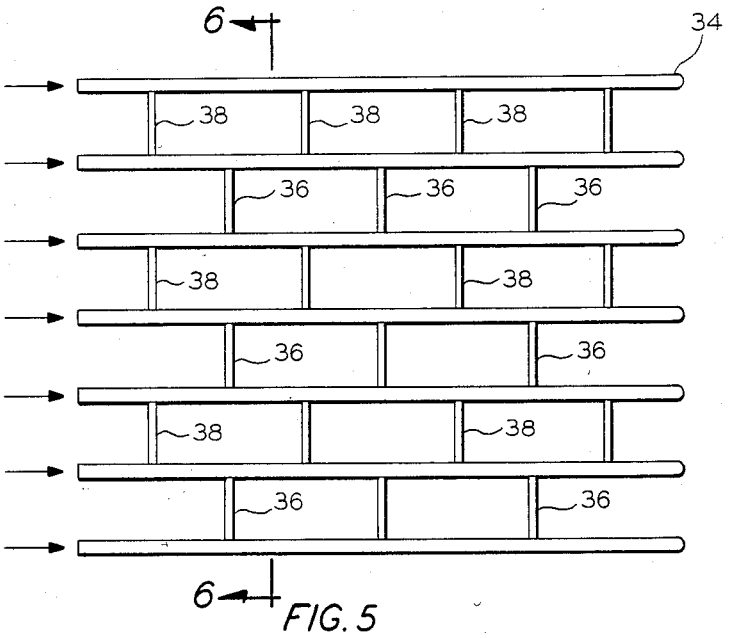
FIG. 5 is a top view of the arrangement of FIG. 4.
Figure 4:
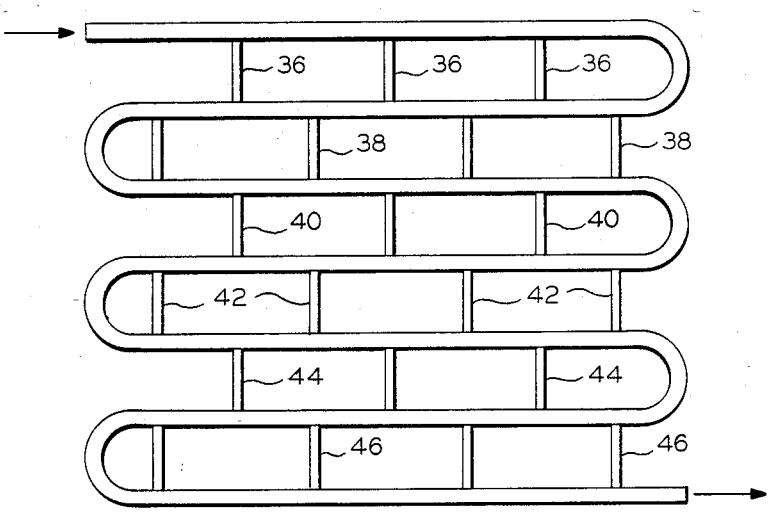
FIG. 4 is a side view of a tubing and baffle arrangement of another embodiment in accordance with the present invention.
Figure 6:
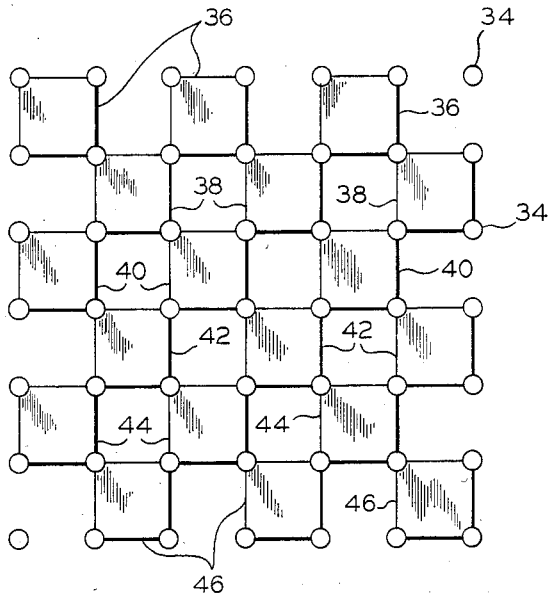
FIG. 6 is a cross sectional view taken along line 6—6 of FIG. 5.

FIGS. 4, 5 and 6 illustrate another such embodiment of the present invention. In FIGS. 4, 5 and 6 the heat exchanger is formed by interconnected tubes 34 formed in generally parallel tube sections, in this case, a square bundle arrangement of straight tube sections. The tubes would be interconnected by a suitable header at the upper entry tubes (not shown) and another suitable header at the lower exit of the tubes (not shown). The tube bundle would be surrounded by an appropriate outer shell (not shown). The baffle plates comprise baffle plates 36, 38, 40, 42, 44 and 46 located on levels 1, 2, 3, 4, 5 and 6, respectively, reading from top to bottom. The baffle plates are also located coincident with planes perpendicular to the tubes. Specifically, the baffle plates 38, 42 and 46 are coincident with one plane and baffle plates 36, 40 and 44 with the next adjacent plane. Again it is to be observed, by reference specifically to FIG. 6, that the baffle plates span one of the void spaces between adjacent combinations of tube sections (4 tube sections) in a plane perpendicular to the tube sections. The baffle plates in each plane are also arranged so as to leave one void space on each side thereof, which is equal in length to one side dimension of the baffle plate. Also the baffle plates are spaced along the length of the tube sections to leave one void space equal in transverse dimensions to a given baffle plate at both the front and the rear of the given baffle plate. Specifically, the baffle plates 38, 42 and 46 leave a void space in the plane coincident with baffle plates 36, 40 and 44 and likewise, the baffle plates 36, 40 and 44 leave a void space therebetween in the plane with which baffle plates 38, 42 and 46 coincide.

Obviously, the heat exchanger of the present invention may take any one of a wide variety of forms being either vertically disposed or horizontally disposed, having a wide variety of shell configurations and having either or both of the tubes in the shell arranged with inlets and outlets so that one or both of the fluids in the tubes or the shell, respectively, may be circulated therethrough. The tubes may also be arranged in any one of a wide variety of configurations or any desired pitch, such as an equilateral triangle pitch, a square pitch, a hexagonal pitch or any other desired arrangement. A square pitch is illustrated and is usually preferred. The heat exchangers are obviously adaptable for use in reactors, such as the stirred reactor illustrated in FIGS. 1–3 of conventional indirect heat exchangers which could utilize an arrangement such as that of FIGS. 4, 5 and 6.

While specific structures and arrangements have been illustrated in the present application, it is to be understood that these are by way of illustration only and modifications, variations and equilvalents thereof will be apparent to one skilled in the art.

What is claimed is:

1. An indirect heat exchanger, comprising:

(a) a vertically-disposed vessel adapted to confine a first fluid;

(b) interconnected, helical tubes, adapted to confine a second fluid in indirect heat exchange with said first fluid, arranged in at least four, spaced, concentric cylinders about the axis of said vessel and at at least four, spaced, vertical levels in each of said concentric cylinders;

(c) a first plurality of vertically-disposed baffle plates, connected to adjacent tubes passing through each of a plurality of first, vertical, radial planes spaced from one another about said axis of said vessel, each of said first baffle plates being arranged in each of said first radial planes in a manner to span the radial distance between at least two said concentric cylinders and betwen at least two said vertical levels;

(d) said first plurality of baffle plates, in each of said first radial planes, being spaced from one another a radial distance equal to the distance between at least two, adjacent concentric cylinders and a vertical distance equal to the distance between at least two adjacent vertical levels;

(e) said first plurality of baffle plates being further arranged, in said first radial planes, to form a plurality of concentric first rows of said first baffle plates at the thus spaced radial and vertical locations set forth in (c) and (d); and (f) a second plurality of vertically-disposed baffle plates, connected to adjacent tubes passing through each of a plurality of second, vertical, radial planes spaced from one another about said axis of said vessel and alternately between said first radial planes, each of said second baffle plates being arranged in each of said second radial planes in a manner to span the radial distance between at least two said concentric cylinders and between at least two said vertical levels;

(g) said second plurality of baffle plates, in each of said second radial planes, being spaced from one another a radial distance equal to the distance between at least two adjacent concentric cylinders and a vertical distance equal to the distance between at least two adjacent vertical levels;

(h) said second plurality of baffle plates being further arranged, in said second radial planes, to form a plurality of concentric second rows of said second baffle plates at the thus spaced radial and vertical locations set forth in (f) and (g);

(i) said concentric first rows of said first baffle plates and said concentric second rows of said second baffle plates being arranged at alternate radial and vertical locations.

2. A heat exchanger in accordance with claim 1 wherein the first radial planes are spaced 45° from the second radial planes.

3. A heat exchanger in accordance with claim 1 or 2 wherein the first rows of first baffle plates are located at successively higher vertical levels and in successively larger concentric cylinders and the second rows of second baffle plates are located at successively higher vertical levels and in successively larger concentric cylinders.

4. An indirect heat exchanger, comprising:

(a) a vertically-disposed vessel adapted to confine a first fluid;

(b) stirring means mounted on the axis of said vessel;

(c) interconnected, helical tubes, adapted to confine a second fluid in indirect heat exchange with said first fluid, surrounding said stirring means and arranged in at least four, spaced, concentric cylinders about the axis of said vessel and at at least four, spaced, vertical levels in each of said concentric cylinders;

(d) a first plurality of vertically-disposed baffle plates, connected to adjacent tubes passing through each of a plurality of first, vertical, radial planes spaced from one another about said axis of said vessel, each of said first baffle plates being arranged in each of said first radial planes in a manner to span the radial distance between at least two said concentric cylinders and between at least two said vertical levels;

(e) said first plurality of baffle plates, in each of said first radial planes, being spaced from one another a radial distance equal to the distance between at least two, adjacent concentric cylinders and a vertical distance equal to the distance between at least two adjacent vertical levels;

(f) said first plurality of baffle plates being further arranged, in said first radial planes, to form a plurality of concentric first rows of said first baffle plates at the thus spaced radial and vertical locations set forth in (d) and (e); and (g) a second plurality of vertically-disposed baffle plates, connected to adjacent tubes passing through each of a plurality of second, vertical, radial planes spaced from one another about said axis of said vessel and alternately between said first radial planes, each of said second baffle plates being arranged in each of said second radial planes in a manner to span the radial distance between at least two said concentric cylinders and between at least two said vertical levels;

(h) said second plurality of second baffle plates, in each of said second radial planes, being spaced from one another a radial distance equal to the distance between at least two adjacent said concentric cylinders and a vertical distance equal to the distance between at least two adjacent said vertical levels;

(i) said second plurality of baffle plates being further arranged, in said second radial planes, to form a plurality of concentric second rows of said second baffle plates at the thus spaced radial and vertical locations set forth in (g) and (h);

(j) said concentric first rows of said first baffle plates and said concentric second rows of said second baffle plates being arranged at alternate radial and vertical locations.

5. A heat exchanger in accordance with claim 4 wherein the first radial planes are spaced 45° from the second radial planes.

6. A heat exchanger in accordance with claim 4 or 5 wherein the first rows of first baffle plates are located at successively higher vertical levels and in successively larger concentric cylinders and the second rows of said second baffle plates are located at successively higher vertical levels and in successively larger concentric cylinders.

* * * * *